US006846072B2

(12) United States Patent
Sato et al.

(10) Patent No.: US 6,846,072 B2
(45) Date of Patent: Jan. 25, 2005

(54) INK, INK-JET INK, INK-TANK, INK-JET CARTRIDGE, INK SUPPLY DEVICE, METHOD FOR INTRODUCING INK TO INK TANK AND IMAGE RECORDING DEVICE

(75) Inventors: Shinichi Sato, Kanagawa (JP); Tetsuji Kurata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 24 days.

(21) Appl. No.: 09/994,724

(22) Filed: Nov. 28, 2001

(65) Prior Publication Data

US 2002/0063761 A1 May 30, 2002

(30) Foreign Application Priority Data

Nov. 29, 2000 (JP) ..... 2000-363685

(51) Int. Cl.[7] ..... B41J 2/175
(52) U.S. Cl. ..... 347/86
(58) Field of Search ..... 347/85–87, 92

(56) References Cited

U.S. PATENT DOCUMENTS 4,968,998 A * 11/1990 Allen ..... 347/7
5,509,140 A * 4/1996 Koitabashi et al. ..... 347/86
5,657,891 A 8/1997 Bilani et al. ..... 220/256
5,663,754 A * 9/1997 Lorenze et al. ..... 347/87
5,790,157 A 8/1998 Higuma et al. ..... 347/85
6,293,663 B1 * 9/2001 Koshikawa et al. ..... 347/86
6,302,533 B1 * 10/2001 Shimomura et al. ..... 347/86
6,540,321 B1 * 4/2003 Hirano et al. ..... 347/22
6,585,362 B2 * 7/2003 Blease et al. ..... 347/92
6,629,758 B2 * 10/2003 Okamoto et al. ..... 347/85
6,637,872 B2 * 10/2003 Ara et al. ..... 347/85

FOREIGN PATENT DOCUMENTS

| | | |
|---|---|---|
| EP | 641594 | 3/1995 |
| EP | 646465 | 4/1995 |
| EP | 684136 | 11/1995 |
| EP | 803364 | 10/1997 |
| EP | 906830 | 4/1999 |
| JP | 7-60987 | 3/1995 |

* cited by examiner

*Primary Examiner*—Michael Nghiem
(74) *Attorney, Agent, or Firm*—Fitzpatrick, Cella, Harper & Scinto

(57) ABSTRACT

An ink tank includes an ink container containing an ink, an ink inlet for introducing the ink to the ink container, an air outlet for maintaining the ink container under negative pressure, and a gas-liquid separation mechanism provided at the air outlet which passes gas but not liquid. The ink is introduced to the ink container through the ink inlet by the negative pressure in the ink container, an inner surface of which being surface-processed, and the ink has surface tension of 28 mN/m or higher but not higher than 50 mN/m.

18 Claims, 13 Drawing Sheets

INK, INK-JET INK, INK-TANK, INK-JET CARTRIDGE, INK SUPPLY DEVICE, METHOD FOR INTRODUCING INK TO INK TANK AND IMAGE RECORDING DEVICE

BACKGROUND OF THE INVENTION

1. Field of the Invention

The present invention relates to an ink, an ink-jet ink, an ink tank, an ink supply device, and a method for introducing ink to the ink tank, as well as an image recording device.

2. Related Background Art

The serial scan system has been used for an ink jet recording device, which comprises a carriage that moves in a primary scanning direction, a recording head as a recording means and a changeable ink tank as an ink container both mounted on the carriage. With this recording system, an image is recorded on a recording medium by repeating scanning of the carriage in the first scanning direction and the movement of the recording medium in a second scanning direction.

When a subminiature printer suitable for a PDA, a camera, etc. is realized by using such a serial scanning recording system, the size of the carriage must be small, so that the capacity of the ink tank to be mounted on the carriage must be extremely small.

Thus, when the capacity of the ink tank on the carriage is very small, frequent exchange of the ink tank will be necessary, or it may happen even a case where the ink tank must be changed in the middle of the recording operation.

Thus, to solve the above problem, an ink supply system called a pit-in ink supply method has been proposed. According to this method, ink is supplied from the separate main tank to the sub tank on the carriage with a proper timing whenever the carriage comes to a predetermined waiting position.

More specifically, whenever one sheet of the recording medium is printed, for instance, the carriage is positioned at a predetermined position and the main and the sub tank on the carriage are connected with a proper timing, and ink is supplied from the main tank to the sub tank. Thus, the problem relating to the ink capacity of the sub tank on the carries is solved.

In the above pit-in ink supply method, the sub tank contains an ink-absorbing member such as sponge inside, and ink is introduced into the sub tank from the main ink tank through an ink inlet due to the negative pressure in the sub tank. The negative pressure in the sub tank is achieved by sucking from an air outlet of the sub tank.

The present applicant has already filed a patent application for an invention concerning the above pit-in ink supply method, where a film or membrane called a gas-liquid separation film (membrane) that passes gas but not liquid is provided at the air outlet also called an atmosphere communication opening.

SUMMARY OF THE INVENTION

The above system provided with a gas-liquid separation membrane can realize a subminiature supply system, and it can also achieve a supply control (control of the pit-in supply amount of the ink and control of negative pressure) in a simple constitution.

During further study and experimentation on the above constitution, the inventors of the present invention have found that when the pit-in supply is repeated, ink may not be supplied in a predetermined amount depending on the ink species.

The inventors investigated the cause and found that when a gas-liquid separation membrane that passes gas but not liquid) was used repeatedly in a durability test, sometimes ink penetrated into the gas-liquid membrane partly to deteriorate the membrane properties.

The present invention was made on such a fact, to provide an ink, an ink tank, an ink-jet cartridge, and an ink supply device that can solve such a problem.

According to an aspect of the present invention, there is provided an ink tank for an ink-jet printing apparatus, which comprises:

(i) an ink container containing an ink;

(ii) an ink inlet for introducing an ink to the ink container; and (iii) an air outlet for making the ink container under negative pressure in cooperation with the ink-jet printing apparatus, an ink being introduced to the ink container through the ink inlet when negative pressure is applied to the ink container, wherein the ink tank further comprises gas-liquid separation means which does not pass liquid but gas at the air outlet, and wherein the ink has surface tension of 28 mN/m or higher but not higher than 50 mN/m.

According to another aspect of the present invention, there is provided an ink-jet cartridge which comprises an ink tank as described above and an ink-jet recording head for ejecting an ink in the ink tank. Another embodiment of the present invention is an ink cartridge which comprises an ink tank as described above and an ink-jet recording head for ejecting the ink in the ink tank, wherein the ink-jet recording head is connected to the ink outlet of the ink tank.

According to still another aspect of the present invention, there is provided an ink supply device for providing an ink to a first ink tank as described above, the device comprises:

(i) a second ink tank for storing the ink to be introduced to the ink container of the first ink tank;

(ii) means for connecting the second ink tank with the ink inlet of the first ink tank; and (iii) means for reducing a pressure in the ink container of the first ink tank through the air outlet of the first ink tank when the second ink tank is connected to the ink inlet of the first tank.

According to still another aspect of the present invention, there is provided an ink to be contained in an ink tank for an ink-jet printing apparatus, where the ink tank comprises an ink container, an ink inlet for introducing an ink to the ink container, an air outlet for making the ink container under negative pressure in cooperation with the ink-jet printing apparatus, and a gas-liquid separation means provided at the air outlet which does not pass liquid but gas, the ink being introduced to the ink container through the ink inlet when negative pressure is applied to the ink container, the ink comprises a coloring material, a liquid medium and a surfactant at a content of 1% by weight or less.

According to still another aspect of the present invention, there is provided an ink tank for an ink-jet printing apparatus, which comprises:

(i) an ink container containing an ink;

(ii) an ink inlet for introducing an ink to the ink container; and (iii) an air outlet for making the ink container under negative pressure in cooperation with the ink-jet printing apparatus, an ink being introduced to the ink container through the ink inlet when negative pressure is applied to the ink container, wherein the ink tank further comprises a gas-liquid separation means which does not pass liquid but gas at the air outlet, and wherein the ink contains a surfactant in an amount of 1 wt % or less based on the total ink weight.

According to still another aspect of the present invention, there is provided a process for introducing an ink to a first ink tank for an ink-jet printing apparatus, wherein the first ink tank comprises:

(i) an ink container containing an ink;

(ii) an ink inlet for introducing an ink to the ink container:

(iii) an air outlet for making the ink container under negative pressure in cooperation with the ink-jet printing apparatus, an ink being introduced to the ink container through the ink inlet when negative pressure is applied to the ink container; and (iv) gas-liquid separation means which does not pass liquid but gas at the air outlet, the process comprises the steps of:

connecting a second ink tank containing an ink to be introduced into the ink container of the first ink to the ink inlet; and reducing pressure of the ink container of the first ink tank while the second ink tank and the ink inlet are being connected.

According to still another aspect of the present invention, there is provided an ink tank for an ink-jet printing apparatus which comprises:

(i) an ink container containing an ink;

(ii) an ink inlet for introducing an ink into the ink container: and (iii) an air outlet for making the ink container under negative pressure in cooperation with the ink-jet printing apparatus, an ink being introduced to the ink container through the ink inlet when negative pressure is applied to the ink container, wherein the ink tank further comprises a gas-liquid separation membrane which does not pass liquid but gas at the air outlet, and wherein the ink is free from disturbing gas permeability of the membrane.

DESCRIPTION OF THE PREFERRED EMBODIMENT

Hereinafter, the present invention is described with reference to the drawings.

In the following description, "printing" or "recording" means formation of any of images, designs and patterns on a print medium, or processing of a print medium, whether the images etc. are meaningful or meaningless, or visual or non-visual to human eyes.

"Print medium" or "recording medium" means any material capable of receiving ink, including not only paper widely used by general printer devices, but also cloth, plastic membrane, metal plate, glass, ceramics, wood, leather etc. Hereinafter, "paper" indicates "print medium".

In the description, "camera" means a mechanism or device to take an optical image and convert the optical image into electrical signals. Hereinafter it is also called an imaging unit.

Also, "ink" or "liquid" is interpreted as wide as the definition of "printing", indicating a liquid which serves, when applied to a print medium, to form images etc., or to process the print medium or to treat the ink, for example, to solidify or insolubilize the coloring matter contained in the ink applied onto the print medium.

Basic Constitution

First, the basic constitution of a device according to the present invention will be described referring to FIGS. 1 to 12 and FIGS. 13A to 13D. An device of the present invention is an information processing device having an imaging unit or camera unit which converts the obtained image into electric signals and an image recording unit (or a printing unit herein) that records an image according to the electric signals. In the following description, the information processing device may be called a "printer built-in camera" or a device body A001.

Figure 5:
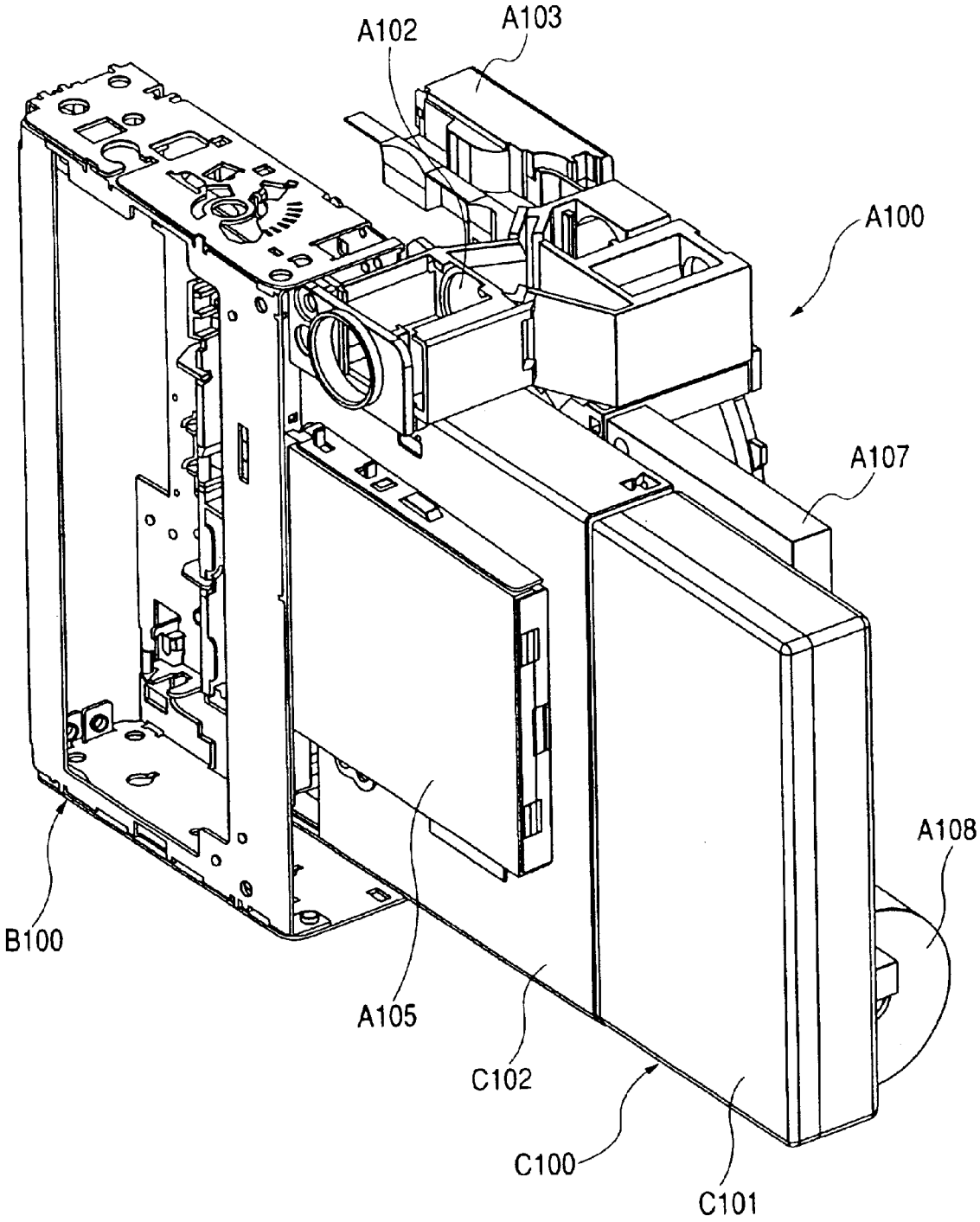
FIG. 5 is a perspective view illustrating an inside arrangement of the main constitution parts of the camera of FIG. 1.

In the device body A001, a printing unit (a recording unit) B100 is assembled integrally to the back of a camera unit A100. The printing unit B100 records an image by using ink and a recording medium provided from the media pack C100. In this constitution, as shown in FIG. 5 where the back casing is removed from the device body A001, a media pack C100 is attached to the right hand side, and a printing unit B100 is attached at the left hand side of the device body A001.

When printing is carried out by the printing unit B100, the device body A001 should be lain in such a position that a liquid crystal display A105 faces upward and a lens A101 faces downward. In such a printing position, a recording head B120 of the printing unit B100 can eject ink downward. Alternatively, the recording position may be the same as the position to take an image by using the camera unit A100. In view of stable recording operation, it is preferable that the ink is ejected downward.

Hereinafter, the basic mechanical constitution of the device of the invention is explained dividing it into I: camera unit, II: media pack, and III: printing unit.

I: Camera Unit

Figure 1:
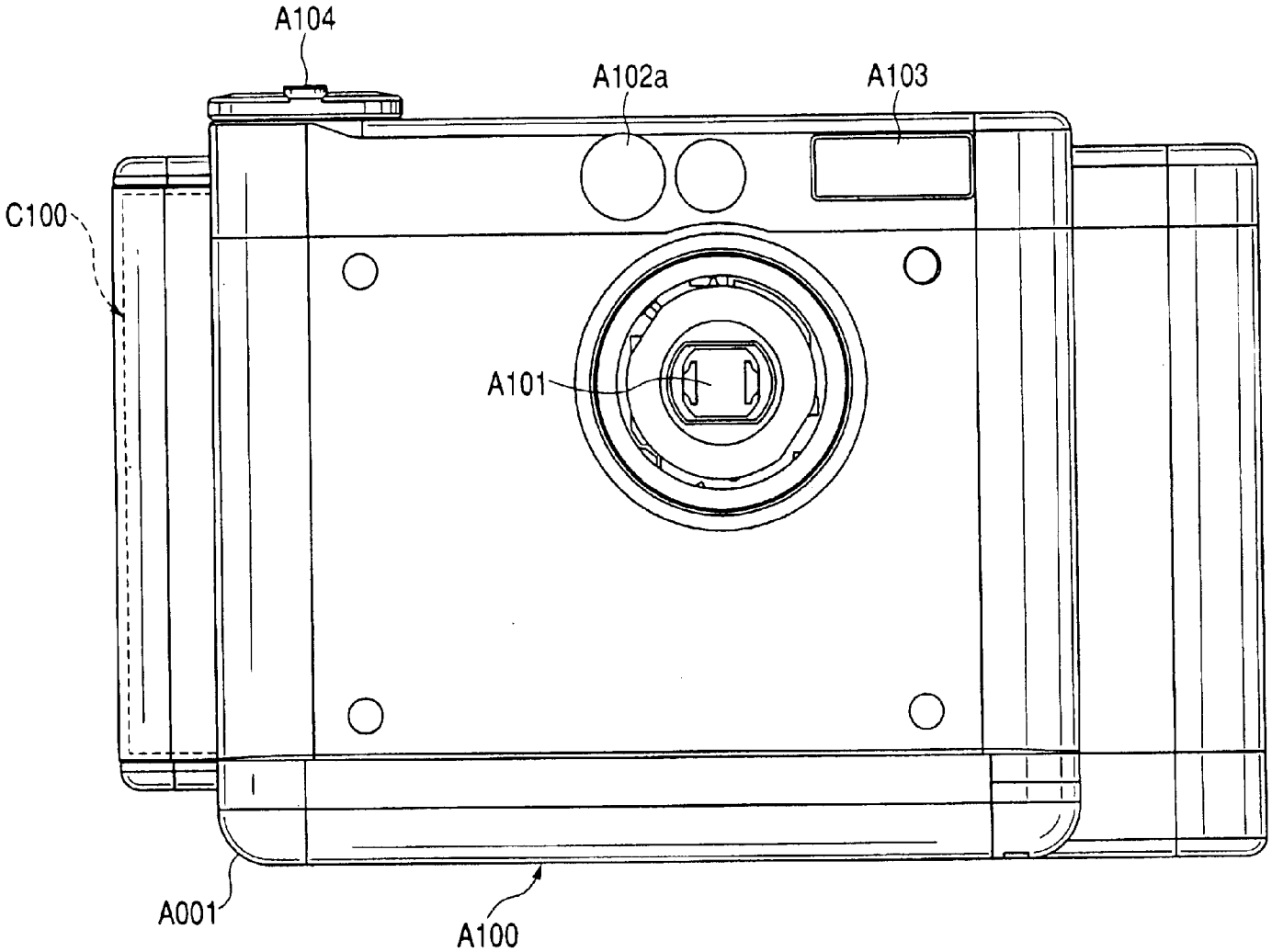
FIG. 1 is a front view of a camera with a built-in printer to which the present invention is applicable.
Figure 2:
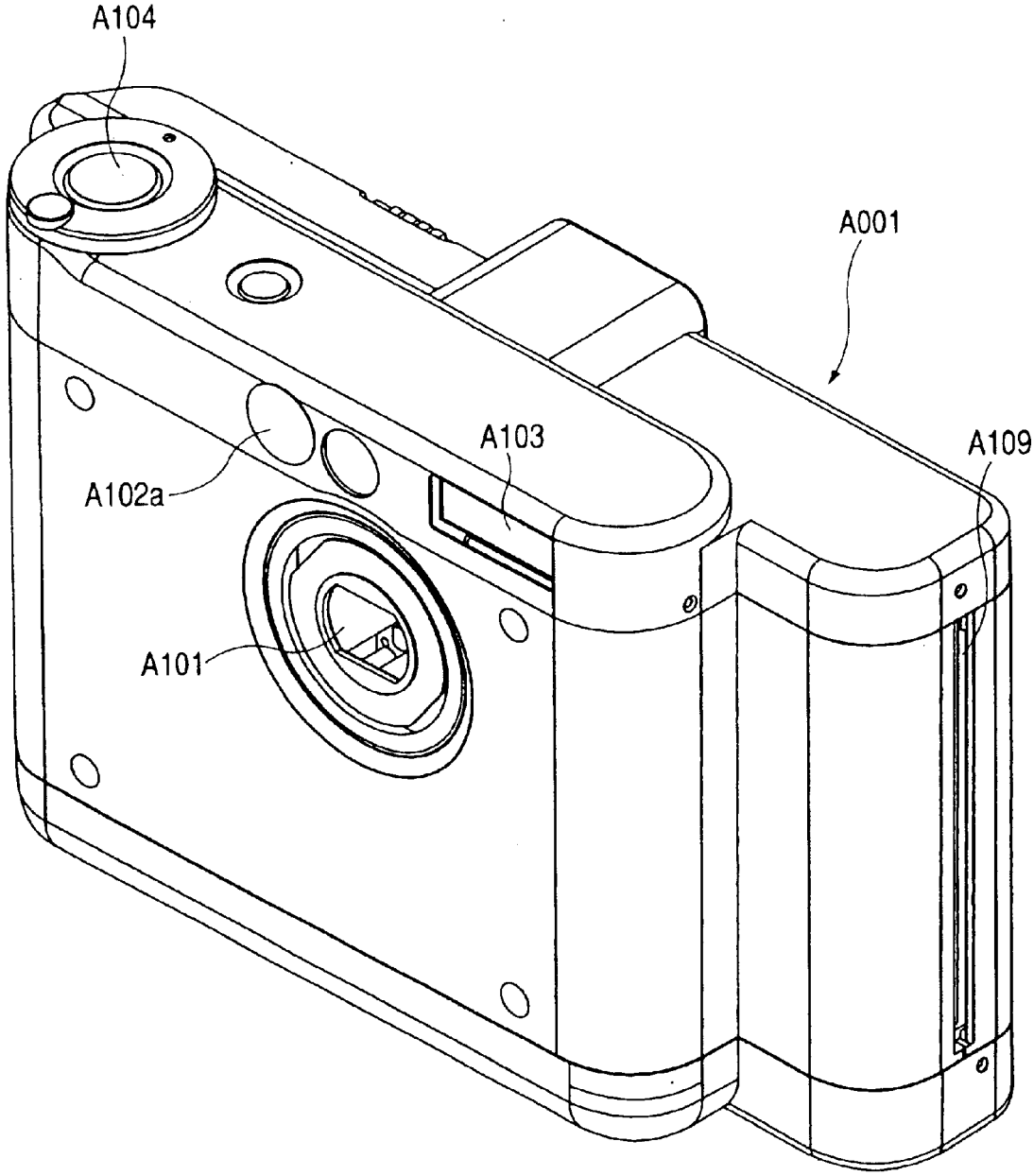
FIG. 2 is an oblique front view of the camera of FIG. 1.
Figure 3:
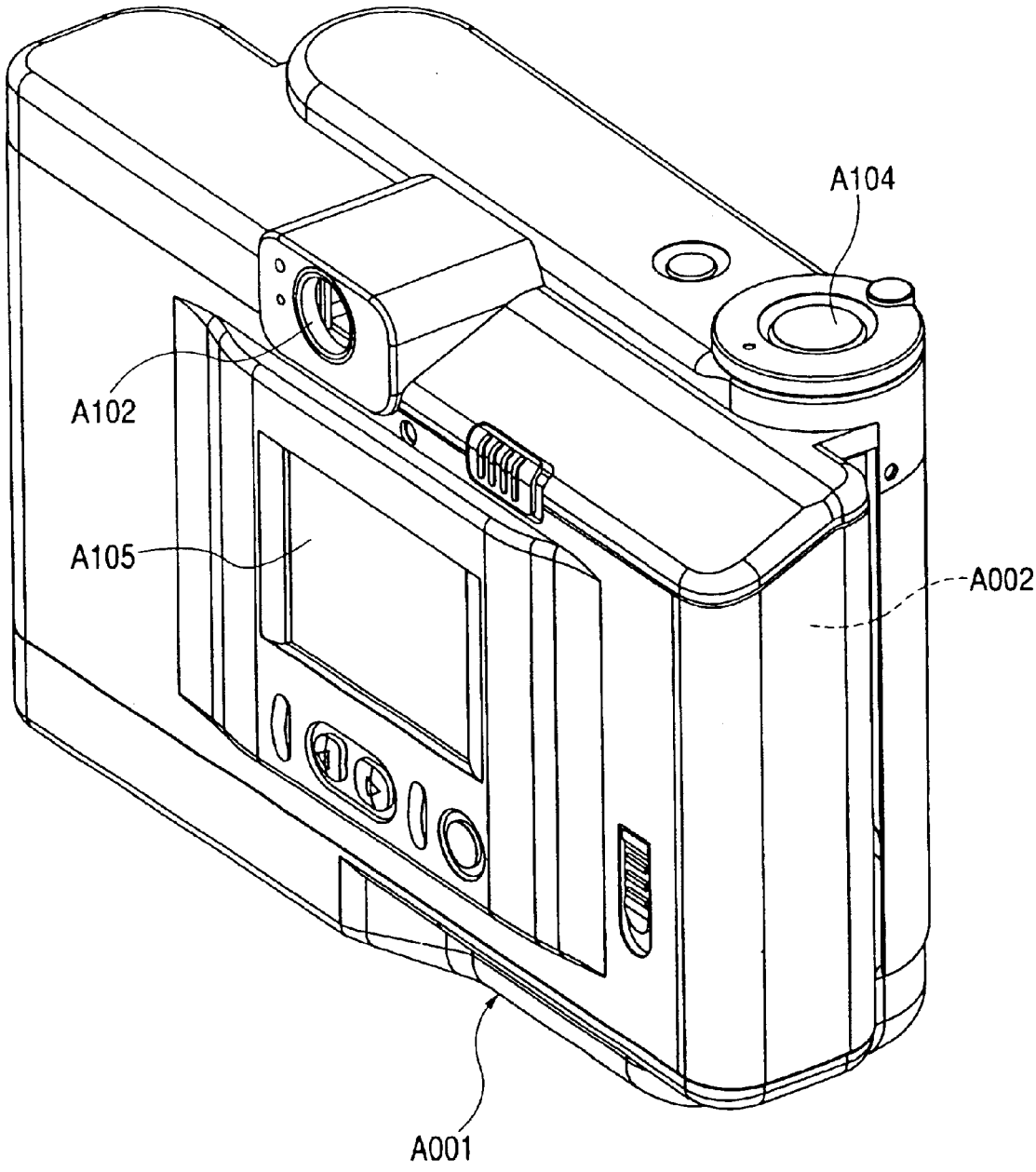
FIG. 3 is an oblique rear view of the camera of FIG. 1.

Basically, the camera unit A100 corresponding to a general digital camera is combined integrally with a printing unit B100 to constitute the device body A001 having the appearance as shown in FIG. 3. In FIGS. 1 to 3, A101 denotes a lens, A102 denotes a finder, A102*a* denotes a finder window, A103 denotes a strobe, A104 denotes a release button, and A105 denotes a liquid crystal display unit (external display unit). The camera unit A100, as described later, processes data picked up using a CCD, stores images to a compact flash memory card (CF card) A107, displays images, and transmits and receives various data between the printing unit B100. A109 denotes a discharge unit for discharging a print medium C104 on which images were recorded. A108 in FIG. 5 denotes a battery as a power source for the camera unit A100 and the printing unit B100.

II: Media Pack

Figure 4:
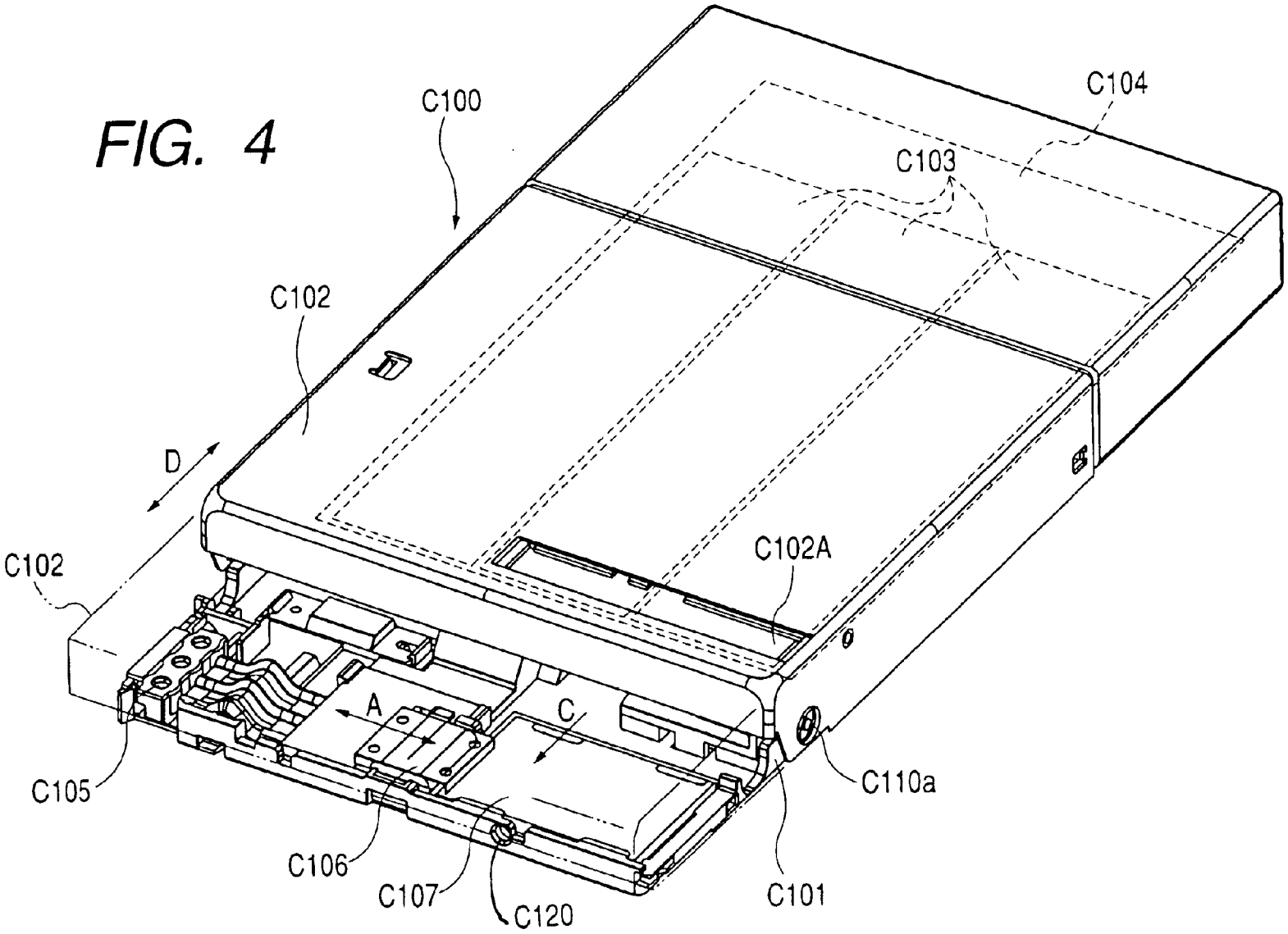
FIG. 4 is a perspective view of a media pack mountable to the camera of FIG. 1.

The media pack C100 is detachable from the device body A001. In this embodiment, C100 is inserted into an insert part A002 (see FIG. 3) of the device body A001 to be mounted to the device body A001 as shown in FIG. 1. When the media pack C100 is not mounted, the insert part A002 is closed as shown in FIG. 3, and it is opened when the media pack C100 is mounted. FIG. 5 shows the device body A001 on which the media pack C100 is mounted and of which casing is removed. As shown in FIG. 4, the main body C101 of the media pack C100 is provided with a shutter C102 slidable in the direction of arrow D. When the media pack C100 is not mounted on the device body A001, the shutter C102 is in a position shown with a two-dotted dash line (the position of C102'), and when the media pack C100 is mounted, C102 slides to the position shown with a real line in FIG. 4.

The body C101 of the media pack C100 contains an ink pack C103 and a print medium C104. In FIG. 4, the ink pack C103 is stored under the print medium C104. In this embodiment, there are three ink packs C103 to contain Y (yellow), M (magenta), and C (cyan) inks respectively, and there are, for example, approximately 20 sheets of print medium C104 in stacks. Those ink packs C103 and print medium C104 are contained in the same media pack C100 in a combination appropriate for desired image recording. Thus, there are a variety of media pack C100, e.g., for ultra high quality printing, normal quality printing, or seal printing, of various combinations of inks and print media, and a media pack C100 is selected and mounted on the device body A001 according to the type of the image to be recorded and the use of the print. Thus, the aimed image can be recorded without fail by using the optimum combination of inks and print medium. Additionally, the media pack C100 is provided with an EEPROM (identification IC) as described later, in which identification data such as the type of inks and print medium contained in the media pack or the residual amounts thereof are stored.

When the media pack C100 is mounted on the device body A001, it is connected to the ink supply system of the device body A001 later described through three joints C105 corresponding to Y, M and C inks respectively. Meanwhile, a sheet of the print medium C104 separated by a separating mechanism (not shown) is supplied in the direction of arrow C by a paper supply roller C110 (see FIG. 9). The driving force of the paper supply roller C110 is supplied via a connection unit C110*a* from a later described conveyer motor M002 (see FIG. 9) provided in the device body A001.

In addition, C101, the body of the media pack, is provided with a wiper C106 for wiping the recording head of the later described printing unit and an ink absorber C107 for absorbing waste ink discharged from the printing unit. As described later, the recording head shuttles along the scanning direction of arrow A in the printing unit. When the media pack C100 is dismounted from the device body A001, the shutter C102 slides to a position shown by the two-dotted dash line in FIG. 4 to protect the joint C105, the wiper C106 and the ink absorber C107.

III: Printing Unit

The printing unit B100 of this embodiment is a serial type using an ink-jet recording head. Here, the printing unit B100 is described in three installments of III-1: Print operation unit, III-2: Print medium drive system, and III-3: Ink supply system.

III-1: Print Operation Unit

Figure 6:
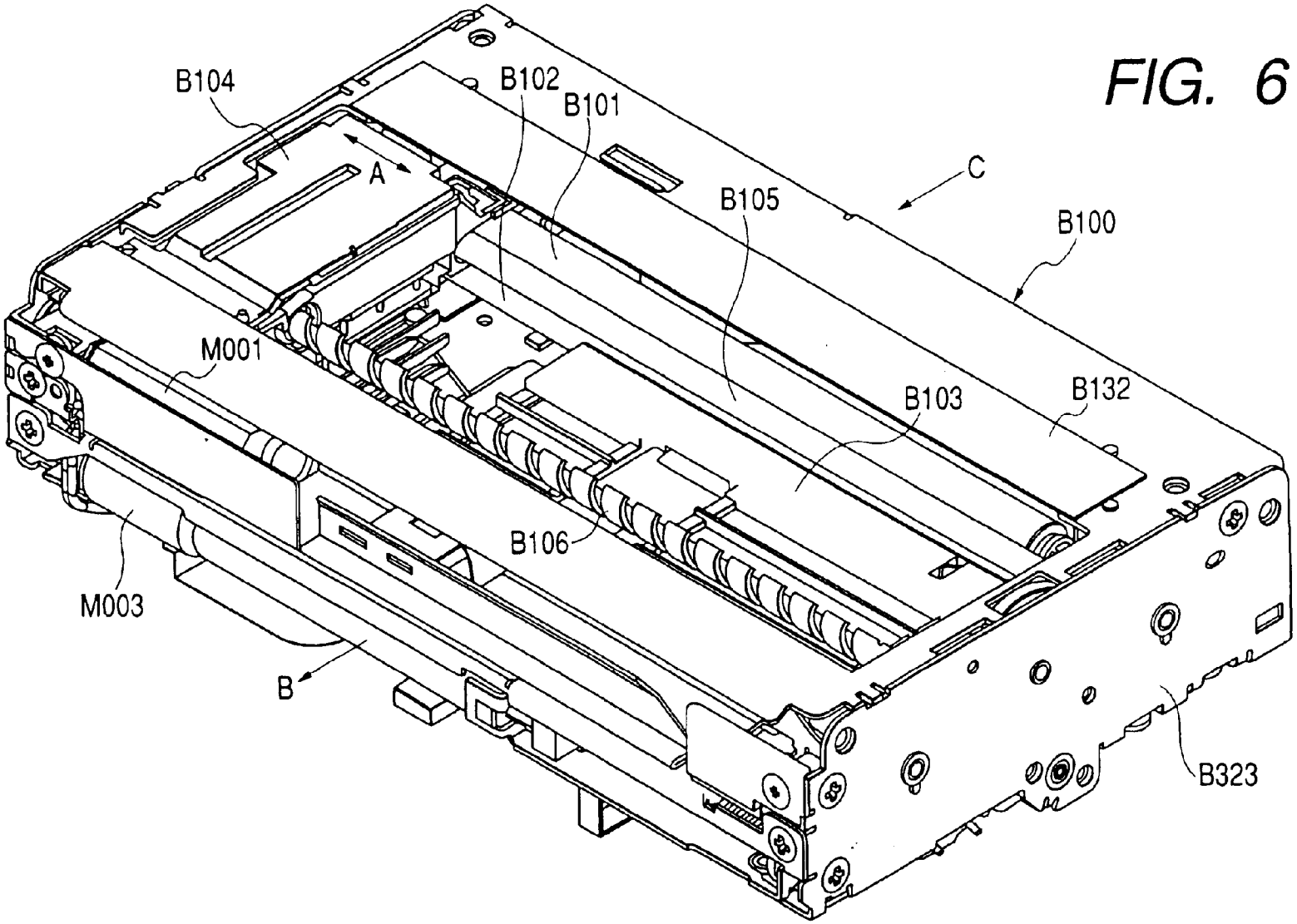
FIG. 6 is a perspective view illustrating a printing unit of FIG. 5.
Figure 7:
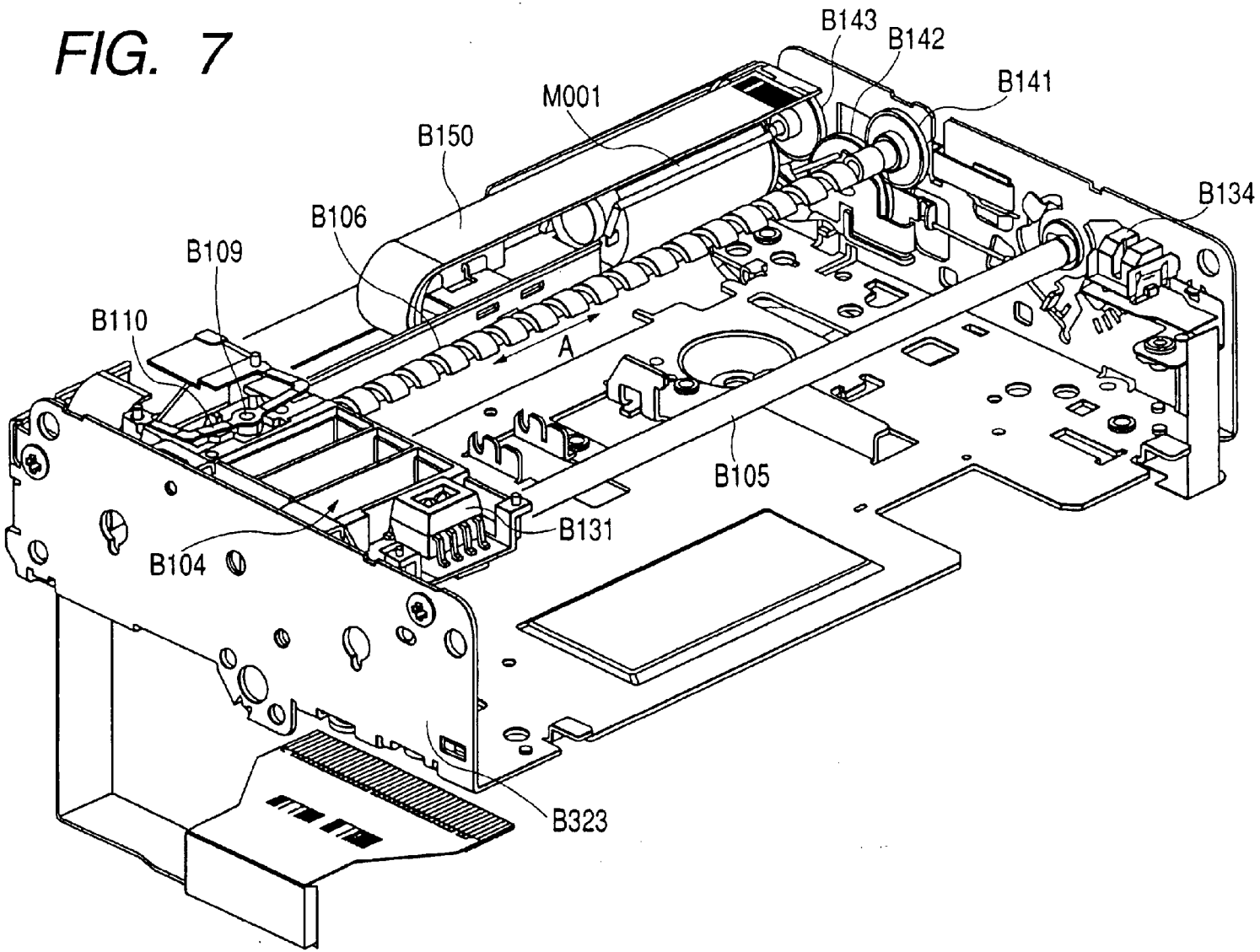
FIG. 7 is an open-up view of the printing unit of FIG. 6.

FIG. 6 is a perspective view of the total printing unit B100 and FIG. 7 is a perspective view of the partly open-up printing unit B100.

As shown in FIG. 5, the top portion of the media pack C100 mounted on the device body A001 is disposed at a predetermined position in the printing unit B100. The print medium C104 supplied from the media pack C100 in the direction of arrow C is driven on a platen B103 in a subscanning direction of arrow B, being held between an LE roller B101 and an LF pinch roller B102 in the print medium transport system. The transport system is described later. B104 denotes a carriage shuttling in the scanning direction of arrow A along a guide shaft B105 and a lead screw B106.

Figure 8:
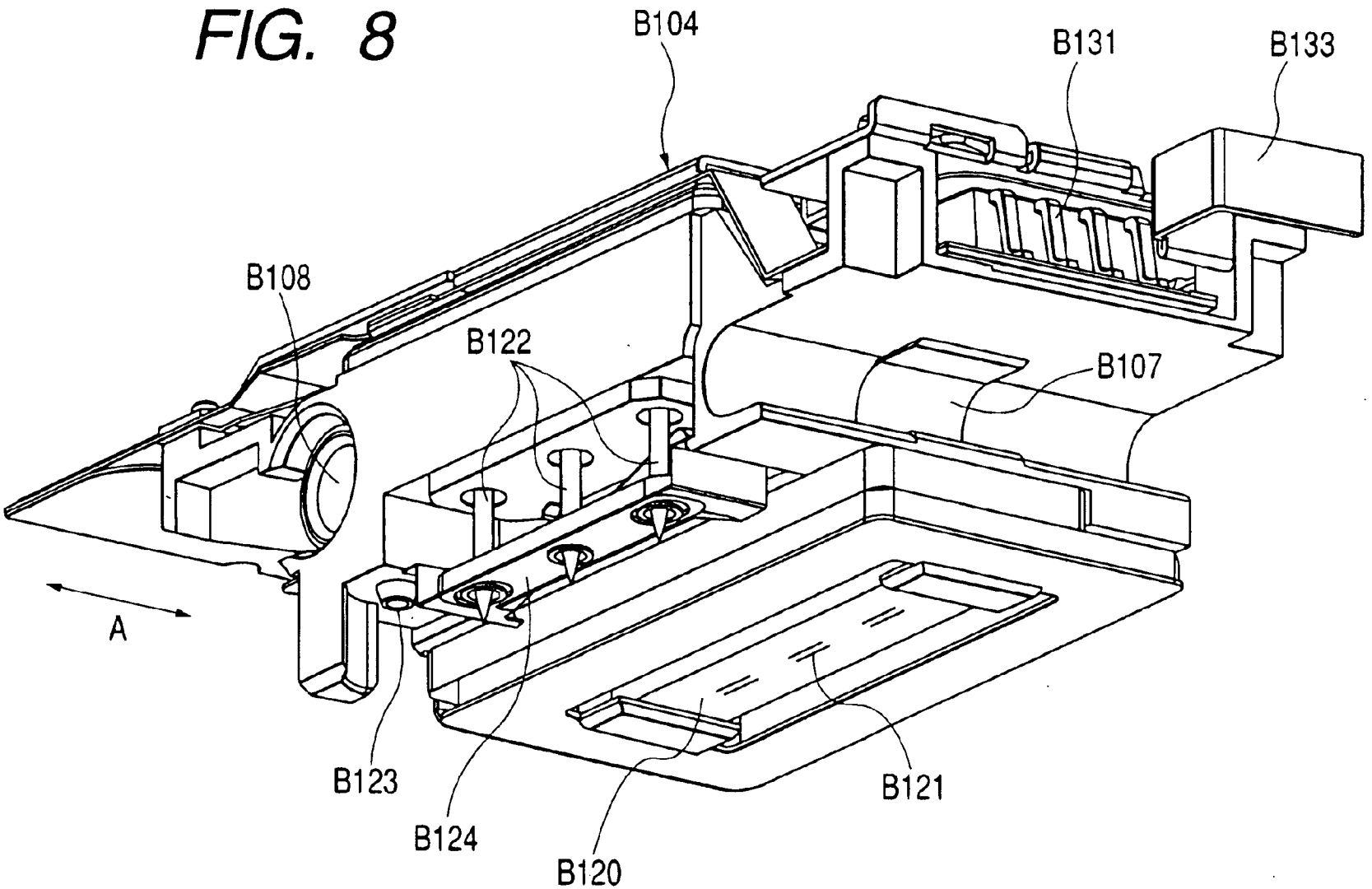
FIG. 8 is a perspective view of the carriage of the printer portion of FIG. 6.

As shown in FIG. 8, the carriage B104 are provided with a shaft bearing B107 for the guide shaft B105 and a shaft bearing B108 for the lead screw B106. At a home position of the carriage B104, as shown in FIG. 7, a screw pin B109 projecting inside the bearing B108 is mounted by a spring B110. The tip of the screw pin B109 fits into the spiral groove on the lead screw B106, so that the rotation of the lead screw B106 is converted into the reciprocal movement of the carriage B104.

The carriage B104 is also provided with an ink-jet recording head B120 capable of discharging Y, M and C inks and with a sub tank (not shown) containing inks to supply them to the recording head B120. The head B120 has a plurality of ink ejection ports B121 (see FIG. 8) arranged in a direction crossing the scanning direction of arrow A (in this example, at right angles). The ink ejection ports B121 constitute nozzles capable of ejecting inks supplied from the sub tank. The energy generating means for ejecting inks, for example, is an electro-thermal converting element provided at each nozzle. The electro-thermal converting element generates heat to form an air bubble in the ink in the nozzle, and an ink droplet is discharged from the ink ejection port B121 by the energy of bubbling.

The ink capacity of the sub tank is smaller than that of the ink pack C103 installed in the media pack C100. but is enough to print one sheet of the print medium C104. The sub tank comprises ink containers for yellow, magenta and cyan inks, and each ink container is provided with an ink inlet through which the ink is supplied and an air outlet through which air is sucked to generate negative pressure in the ink container. These ink inlets are respectively connected to three hollow needles B122, and these air outlets are connected to a common air suction port B123. Such a sub tank receives inks from the ink pack C103 in the media pack C100 when the carriage B104 returned to the home position as shown in FIG. 6. This is described later in detail.

In the carriage B104 of FIG. 8, B124 is a needle cover. When the needle B122 and the joint C105 of the media pack are not connected, the cover B124 comes in a position to protect the needle B122, as shown in FIG. 8, by action of an unshown spring. On the other hand, when the needle B122 and the joint C105 are connected, the cover B124 is pushed upward against the force of the spring to release the protection of the needle B122. The moving position of the carriage B104 is detected by an encoder sensor B131 of the carriage B104 and a linear scale B132 (see FIG. 6) of the body of the printing unit B100. The movement of the carriage B104 to the home position is detected by an HP (home position) plug B133 of the carriage B104 and an HP sensor B134 (see FIG. 7) of the body of the printing unit B100.

In FIG. 7, at both ends of the guide shaft B105, a support shaft (not shown) decentered from the central axis of B105 is provided. The support shaft controls the rotation of the guide shaft B105, which controls the position of the carriage B104 so as to control the distance between the recording head B120 and the print medium C104 on the platen B103.

The lead screw B106 is rotated by a carriage motor M001 via a screw gear B141, an idler gear B142 and a motor gear B143. B150 denotes a flexible cable electrically connecting the recording head B120 and a control system described later.

Moving in the main scan direction with the carriage B104, the head B120 records one line image on the print medium C104 on the platen B103 by ejecting ink from the ink ejection port B121 according to image signals. By repeating one-line recording operation by the head B120 and carriage of the print medium in the subscanning direction of arrow B for a certain distance by the following print medium carriage system by turns, an image is recorded on the print medium in order.

III-2: Print Medium Carriage System

Figure 9:
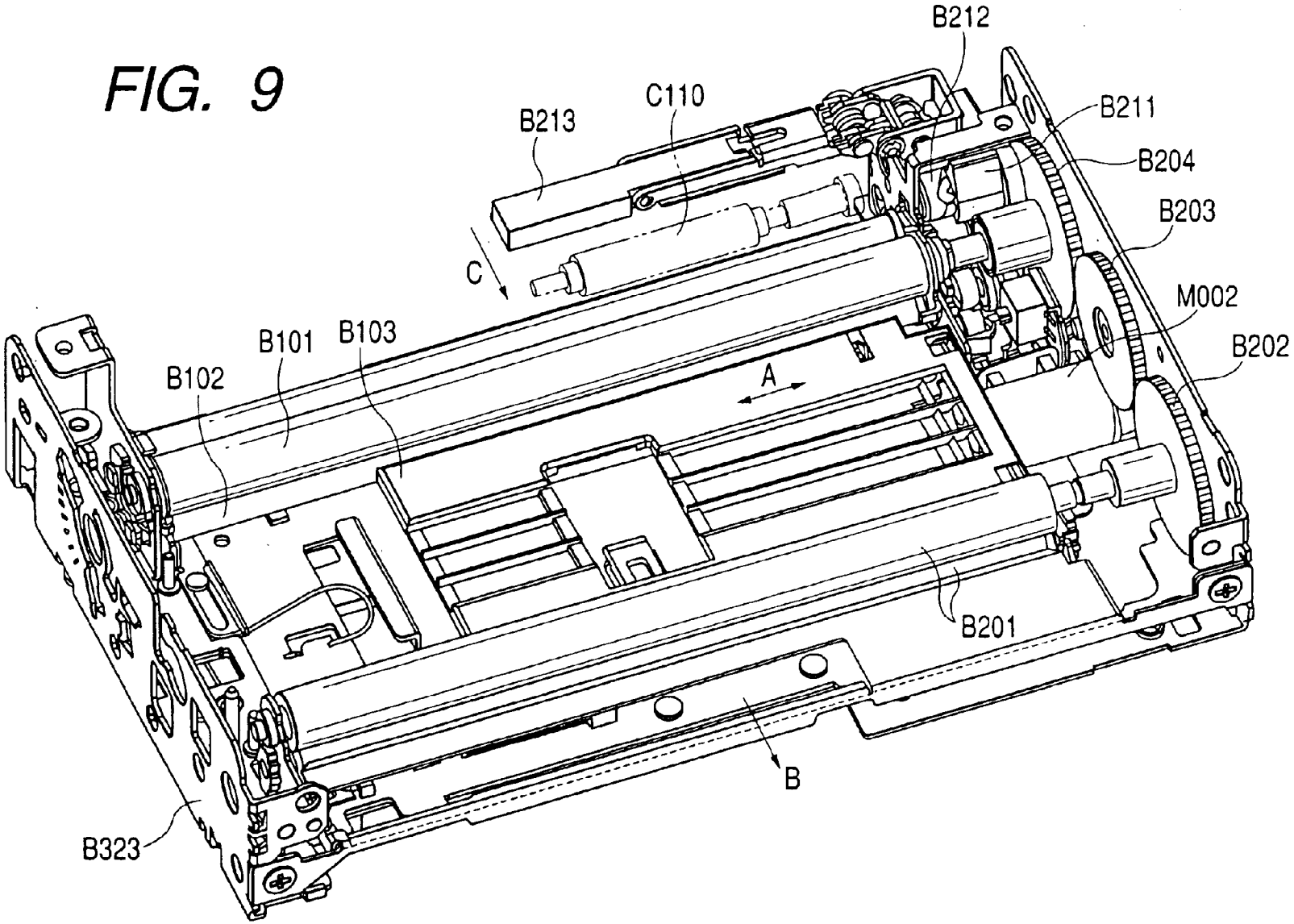
FIG. 9 is a perspective view illustrating a constitution parts of a print medium transfer system in the printing unit of FIG. 6.

FIG. 9 is a perspective view of the constitution of the print medium carriage system in the printing unit B100. In FIG. 9, B201 denotes a pair of paper discharge rollers. In FIG. 9, the upper roller B201 is driven by the carriage motor M002 via a paper discharge roller gear B202 and a relay gear B203. In the same manner, the roller B101 is driven by the motor M002 via a LF roller gear B204 and the relay gear B203. The paper discharge roller B201 and the LF roller B101 carry the print medium C104 in the direction of arrow B by the driving force of the carriage motor M002 in normal rotation.

On the other hand, when the carriage motor M002 is reversely rotated, a press plate head B213 and a lock mechanism (not shown) are driven trough a switching slider B211 and a switching cum B212, and the driving force is transmitted to the paper supply roller C110 in the media pack C100. That is, the plate head B213 presses the print medium C104 piled in the media pack C100 downwardly in FIG. 4 through a window C102A (see FIG. 4) of the shutter C102 by the driving force of the carriage motor M002 in reverse rotation. Accordingly, the lowermost sheet of the print medium C104 in FIG. 4 is pressed to the paper supply roller C110 in the media pack C100. While, the lock mechanism (not shown) prevents release of the media pack C100 locking the media pack C100 to the device body A001 by the driving force of the carriage motor M002 in reverse rotation. Then the paper supply roller C100 of the media pack 100 conveys the sheet C104 at the lowest position of FIG. 4 in the direction of arrow C by the driving force transmitted from the carriage motor M002 at its reverse rotation.

In this way, by the reverse rotation of the motor M002, only one sheet of the print medium C104 is taken out from the media pack C100 in the direction of arrow C, and then, by the normal rotation of the carriage motor M002, the sheet is conveyed in the arrow direction.

II-3: Ink Supply System

Figure 10:
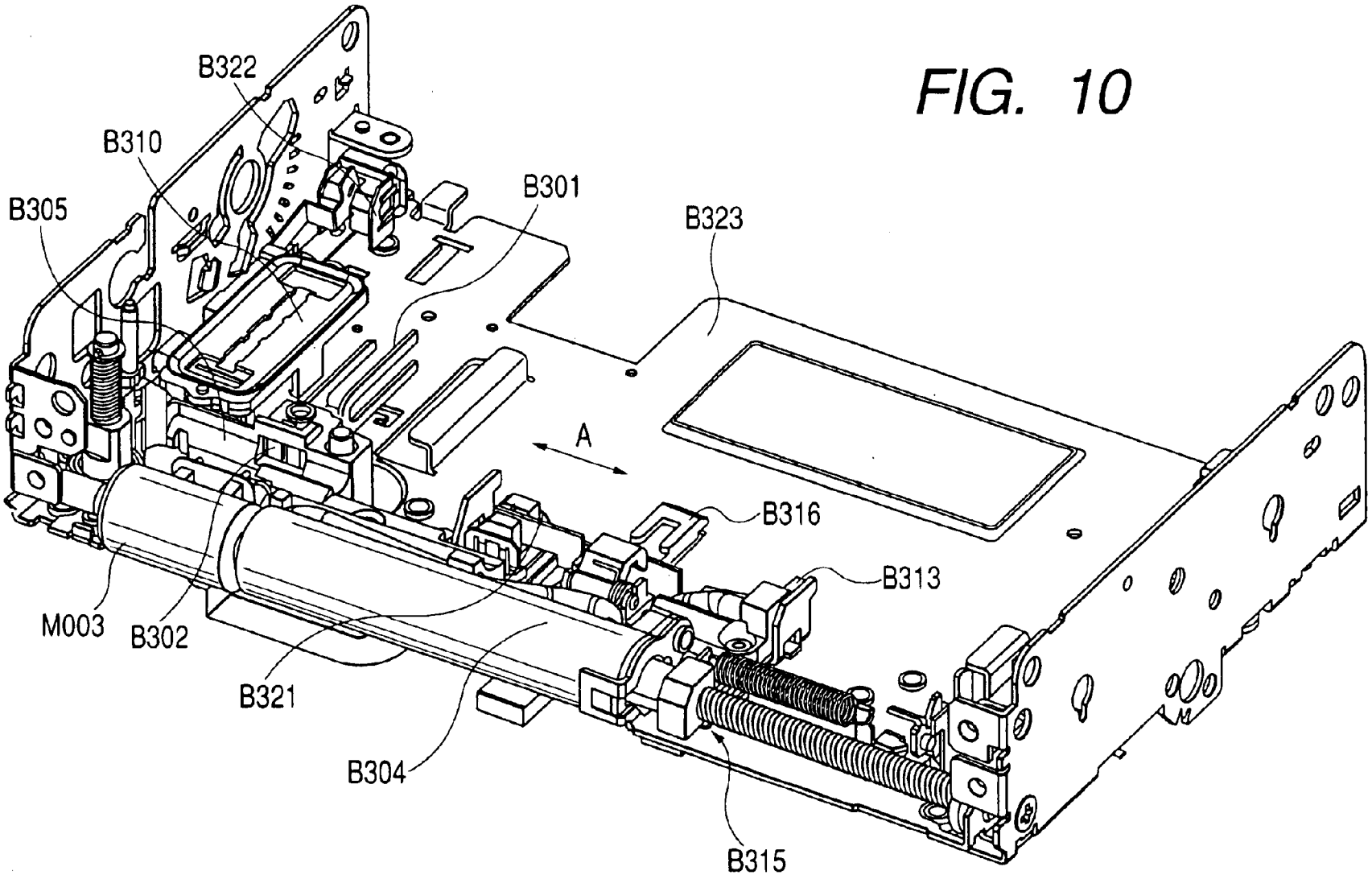
FIG. 10 is a perspective view of constitution part of an ink supply system in the printing unit of FIG. 6.
Figure 11:
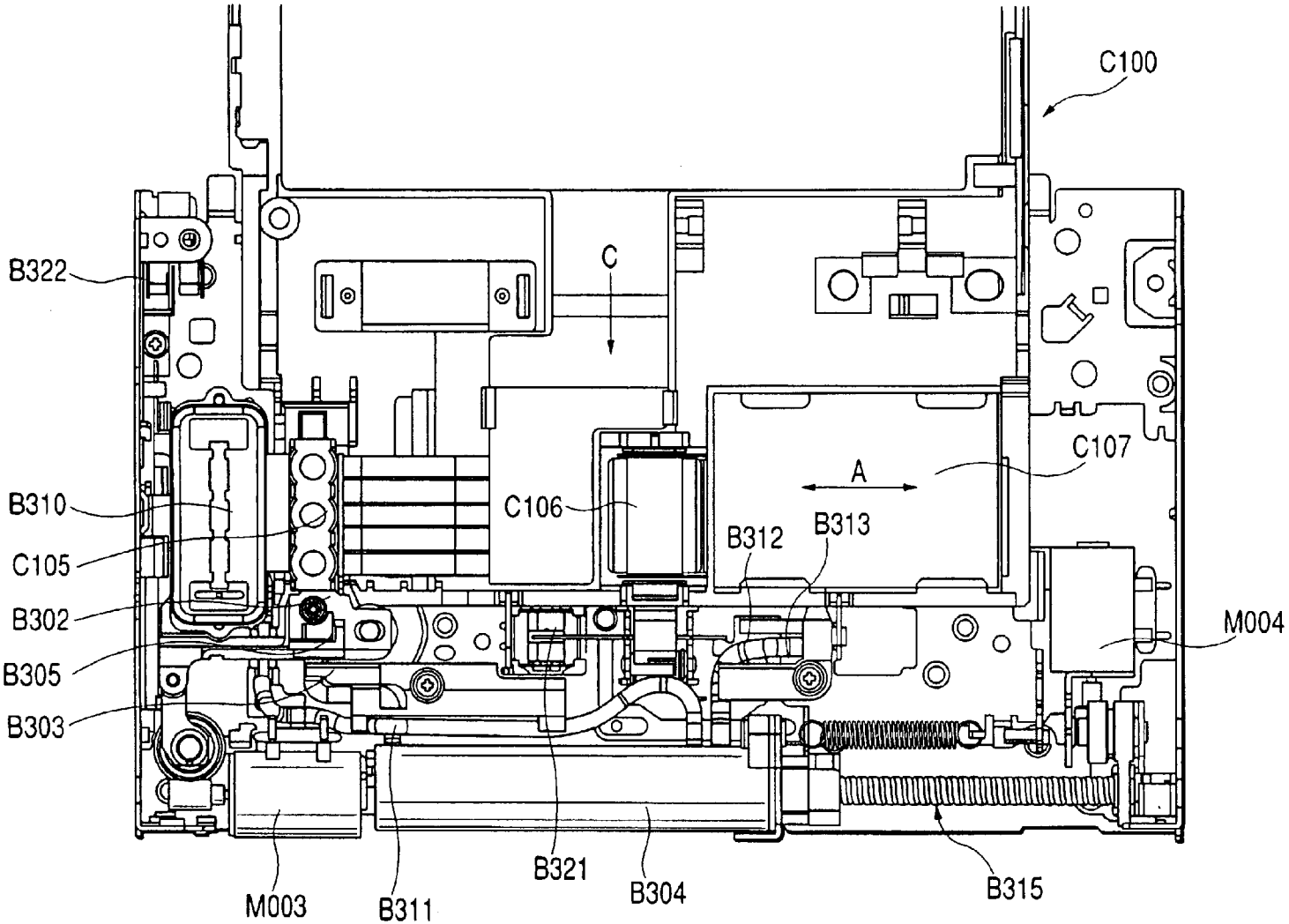
FIG. 11 is a plan view of a media pack mounted to the constitution part of the ink supply system of FIG. 10.

FIG. 10 is a perspective view of the constitution of an ink supply system in the printing unit B100, and FIG. 11 is a plane view when the media pack C100 is mounted in the constitution of the ink supply system.

The joint C105 of the media pack C100 mounted to the printing unit B100 comes under the needle B122 (see FIG. 8) of the carriage B104 when the carriage B104 comes to the home position. Under the joint C105, a joint fork B301 (see FIG. 10) provided to the body of the printing unit B100 comes. The joint fork B301 moves the joint C105 upwardly so that the joint C105 is connected to the needle B122. Accordingly, an ink supply path is formed between the ink pack C103 of the media pack C100 and the ink inlet of the sub tank B400 of the carriage B104.

The body of the printing unit B100 is provided with a feed joint B302 which comes under the air suction port B123 (see FIG. 8) of the carriage B104 at the home position. This feed joint B302 is connected to a pump cylinder B304 of a pump as a negative pressure generation source via a feed tube B303. The joint B302 is moved upwardly by a joint lifter B305 to be connected to the air suction port B123 of the carriage B104. The joint lifter B305 moves the joint fork B301 and the joint B302 up and down by the driving force of the joint motor M003.

The air outlet of the sub tank B400 is provided with a gas-liquid separation member (not shown) for permitting the passage of air and inhibiting the passage of ink. The gas-liquid separation member permits suction and passage of air in the sub tank through the suction path, and accordingly ink is supplied from the media pack C100 to the sub tank. Then, when the ink is sufficiently supplied to the sub tank and reaches to the gas-liquid separation member, the gas-liquid separation unit inhibits passage of the ink and supply of the ink is automatically stopped. Since the gas-liquid separation member is provided to the air outlet of each ink container of the sub tank, supply of respective inks is automatically controlled.

The body of the printing unit B100 is also provided with a suction cap B310 which caps the recording head 120 (see FIG. 8) moved to the home position. The suction cap B310 can suck and remove the ink in the ink ejection port B121 of the recording head B120 (suction recovery process) through the negative pressure inside introduced by the pump cylinder B304 via the suction tube 311. If necessary, the recording head B120 can eject ink not participating in image recording into the suction cap B310 (preliminary ejection process). The ink in the suction cap B310 is drained to the ink absorption body C107 in the media pack C100 via the pump cylinder B304, a waste tube B312 and a waste liquid joint B313.

The pump cylinder B304 constitutes a pump unit B315 with a pump motor M004 which drives the pump cylinder B304 reciprocally. The pump motor M004 also functions as a driving force of the up and down motion of a wiper lifter B316 (see FIG. 10). The wiper lifter B316 drives a wiper C106 of the media pack C100 mounted on the printing unit B100 up and down, so that the wiper C106 is moved to the position where the wiper can wipe the recording head B120.

In FIGS. 10 and 11, B321 denotes a pump HP sensor that detects whether the operating position of the pump cylinder B304 is at the home position or not. B322 denotes a joint HP sensor for detecting the formation of the above-described ink supply path and suction path. B323 denotes a chassis constituting the body of the printing unit B100.

In this embodiment, the camera unit A100 and the printing unit B100 are integrated into a printer built-in camera. However, it is possible to realize the same function by separating the camera unit A100 and the printing unit B100 into individual units connected by an interface.

An embodiment of the ink supply system in the present invention is now described in more detail referring to drawings.

<Ink Supply Recovery System>

Figure 12:
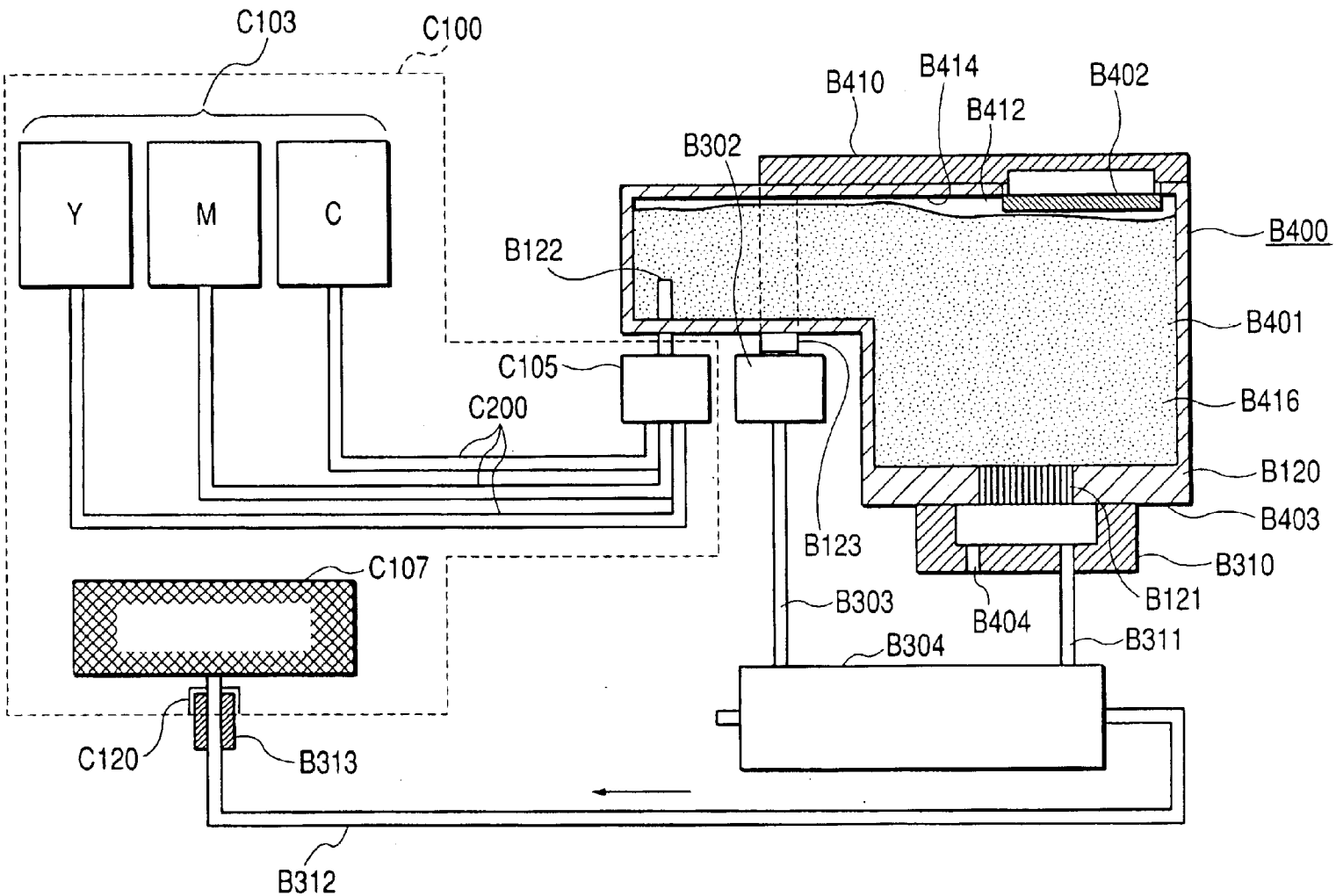
FIG. 12 illustrates a constitution outline of an ink supply recovery system.

FIG. 12 shows a constitution concept of an ink supply recovery system.

In FIG. 12, the media pack C100 contains three ink packs (also referred to as main tanks) C103 filled with three color inks of Y (yellow), M (magenta) and C (cyan). The three ink packs C103 are connected to three joints (ink joints) C105 via three ink supply paths C200.

The media pack C100 has a waste introduction opening C120 (see FIG. 4) into which a waste joint B313 (see FIG. 10) installed at the tip of the waste tube B312 of the printing unit B100 is inlet. The media pack C100 is provided with a waste ink absorber C107 for containing waste ink introduced via waste introduction opening C120 from the pump cylinder B304.

The carriage B104 is provided with sub tanks (carriage tanks) B400 for storing Y, M and C inks respectively and a recording head B120 having a plurality of ink ejection ports (nozzles) B121 divided into three groups (Y, M and C) for ejecting each ink supplied from corresponding carriage tank B400.

Each ink-container (ink supply unit) of the sub tank B400 is nearly filled with an ink absorber B401, a sponge made of polypropylene fiber etc., to absorb and hold ink. As shown in FIG. 8, each ink container of the sub tank B400 is provided with a needle (an ink inlet) B122 having a through hole and projecting downward. These three needles B122 can be connected to three rubber joints C105 of the media pack C100 when the carriage B104 is moved to the home position. As a result, a main tank C103 is connected to the ink container B416 of the sub tank B400 via an ink supply path C200 communicated to the main tank C103, an ink joint C105 provided at the end of the ink supply path and the needle B122 of the sub ink tank B400, so that the ink contained in the main tank C103 is supplied to the ink container B416 of the sub ink tank B400.

At the upper part of each ink container of the sub tank B400, an air outlet B410 is formed. At the air outlet B410, as described above, a gas-liquid separation member, a porous membrane (ink filling up valve) B402 is provided. The porous membrane has been treated to be water-repellent and oil-repellent to pass gas but not ink. Since the porous membrane B402 inhibits passage of the ink, so that the supply of ink is automatically stopped when the liquid level of the ink in the sub tank B400 reached to the porous membrane B402.

Each air outlet B410 of the sub tank B400 is in communication with a common air suction port B123 (see FIG. 8) formed at the downward face of the carriage B104, as described above. This air suction port B123 can be connected to a supply joint B302 installed at the body of the printing unit B100 when the carriage B104 moves to the home position, thereby connected to one of the cylinder chambers of the pump cylinder B304 via the supply joint B302 and a supply tube B303.

The printing unit B100 is provided with a suction cap B310 for capping the facing surface (on which an ink ejection port is formed) of the recording head B120 on which a plurality of ink ejection ports (nozzles) B121 for three groups of Y, M and C when the carriage B104 is moved to the home position. The suction cap B310 is provided with an air communication port B404. This air communication port B404 can be opened and closed by an air communication valve (not shown). Here, the ink ejection port B121 becomes an ink supply port for supplying the ink contained in the ink containing unit of the sub ink tank to the outside. In addition, within the limits of the present invention, the recording head B120 can be formed as a separate member from the sub ink tank B400 and the recording head can be connected to the ink supply port provided at the sub ink tank B400.

The suction cap B310 is connected to another cylinder chamber of the pump cylinder B304 through a suction tube B311.

The pump cylinder B304 has three ports being connected to the supply tube B303, suction tube B311 and waste tube B312.

Meanwhile, it is preferable that there is a space B412 between a gas permeable member B402 and the ink absorber B401 provided inside the sub tank B400 as shown in FIG. 12, not to contact with each other. When the gas permeable member B402 is in contact with the ink for a long period, the gas-liquid separation function may be deteriorated. In this embodiment, however, there is a space between the gas permeable member B402 and the ink absorber B401 so as to prevent direct contact between them, thereby the member B402 and the ink would not contact except for the period of ink supply. Therefore, the degradation of the function of the gas permeable member B402 can be prevented. It is also preferable that the inner surface (e.g., the surface denoted by B414) surrounding the space B412 is constituted in such a manner that adhesion of the ink is suppressed as much as possible by the surface treatment, for example, by giving water-repellency.

-Compatibility Between Gas-Liquid Separation Membrane and Ink-

Hereinafter, the compatibility between a gas liquid separation membrane B402 and ink used for the above-described supply system will be described, which is the feature of the present invention.

The present inventors have examined the gas-liquid separation function using various inks in the above supply system to find that with certain inks the gas permeable function is not maintained to the predetermined number of times of ink replenishment.

Figure 13A:
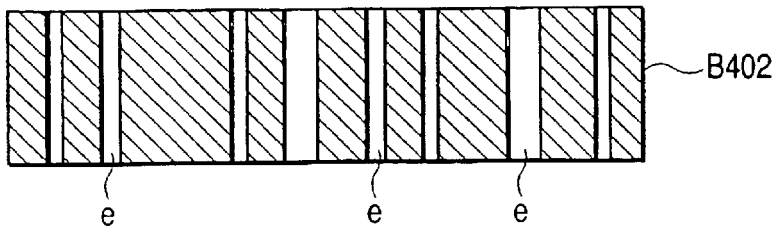
FIGS. 13A, 13B, 13C and 13D illustrates action of a gas-liquid separation membrane.

FIGS. 13A through 13D are schematic enlargements of the vicinity of the gas-liquid separation membrane B402. FIG. 13A shows the normal state of the gas-liquid separation membrane B402. The gas-liquid separation membrane B402 itself has a plurality of micropores as shown in FIG. 13A, and usually the inside of the container is communicated to the outside thereof.

Figure 13B:
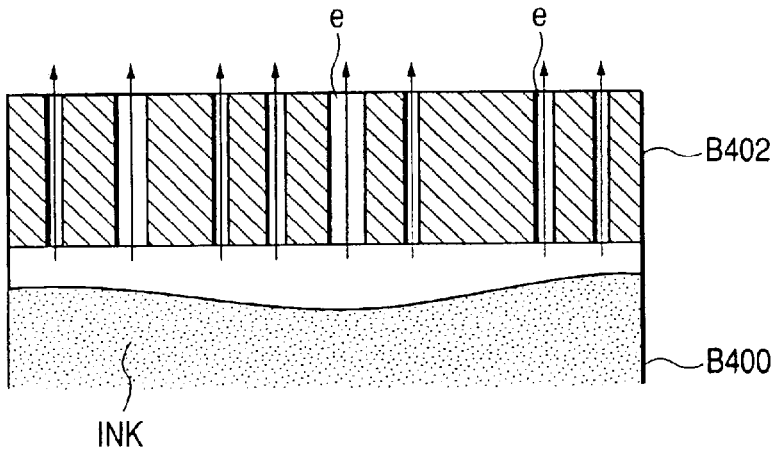

FIG. 13B shows the state where ink is supplied into the sub tank B400 by the above described supplement operation. As shown in the drawing, when the ink supplied into the sub tank B400 reaches the gas-liquid separation membrane B402, the supply of ink is stopped by the above-described function that passes gas but not liquid.

Usually, the liquid level lowers as the ink is consumed in the printing operation, and the ink is introduced again into the sub tank B400 when necessary.

Figure 13C:
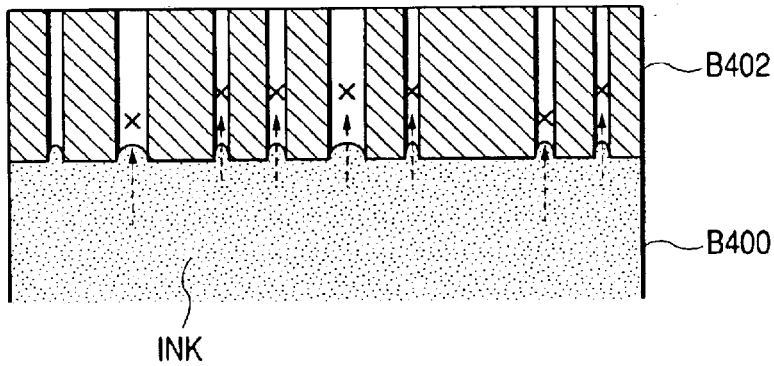

As shown in FIG. 13C, however, ink of certain types penetrates into the micropores e of the membrane B402 to form meniscus when the ink supply operation is repeated many times, inhibiting gas communication after that.

Figure 13D:
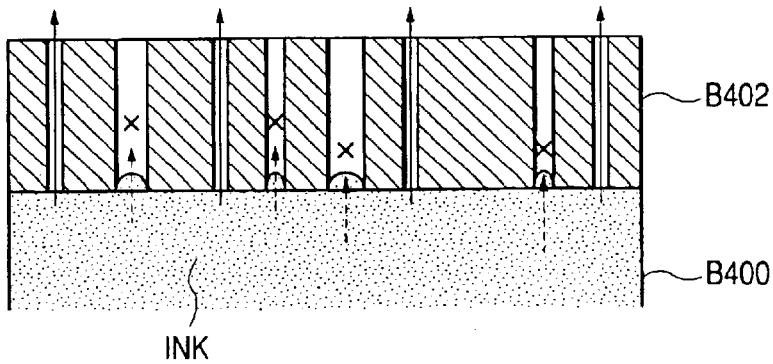

Furthermore, as shown in FIG. 13D, there is a case where the micropores e are clogged at the interface between ink and the membrane B402. Although the cause has not been clarified in detail, the inventors thinks that such a failure occurs due to the interaction (reaction) between a detergent in the ink and the membrane B402.

Anyway, properties of the gas-liquid separation membrane B402 may be deteriorated according to the types of the ink.

Usually, ink contains a coloring material such as a pigment or dye, an aqueous medium to maintain the coloring material in a dissolved or dispersed state or both, various aqueous solvents to prevent solidification of the ink, an aqueous solvent or surfactant to control physical properties of the ink or penetration properties into a recording medium, and salts to control electric properties or pH of the ink and so on.

Investigating the deterioration of the membrane, the inventors have found that among the various ink components the amount of the surfactant is closely related to the performance of the membrane in gas-liquid separation.

Surfactants reduce surface tension or improve wettability of a liquid, and they tend to gather at the interface when the ink contacts the gas-liquid exchange portion.

The reason why the amount of the surfactant and the performance of the membrane B402 are co-related is presumed as follows on the basis of the above surfactant properties.

1. Addition of a surfactant lowers the surface tension of the ink, so that the ink tends to penetrate into the gas-liquid separating member to form meniscus therein, which deteriorates air-permeability.

2. Addition of a surfactant to ink changes wettability of the ink to the surface of the gas-liquid separation member so that the ink tends to penetrate into the member to form meniscus therein, which deteriorates air-permeability.

3. Addition of a surfactant to ink causes aggregation of the surfactant molecules at the interface of the gas-liquid separation member to change the contact angle of the ink to the gas-liquid separation member so that the ink tends to penetrate into the member to form meniscus therein, which deteriorates air-permeability.

4. Addition of a surfactant to ink causes aggregation of the surfactant molecules at the interface of the gas-liquid separation member and interact with the surface material of the gas-liquid separation member to change the water repellent and oil repellent properties of the surface material, which deteriorates the function of the gas-liquid separation member.

In this regard, although the allowed amount of such a surfactant in the ink varies according to the species, it is preferable the amount of the surfactant is as small as possible. For example, a surfactant may be added in an amount preferably 1% by weight or less, more preferably 0.5% by weight or less. Further, a good result can be obtained regardless of the surfactant species when the amount is 0.2% or less.

When the surfactant is added within such a range as described above, it can prevent the ink from flowing into micropores e of the gas-liquid separation membrane B402.

Further, the inventors have found that to maintain the original performance of the gas-liquid separation member, the surface tension of the ink is preferably not less than 28 mN/m and not higher than 50 mN/m, and when the surface tension is 35 mN/m or above, good results can be obtained regardless of the species of the surfactant.

Conventionally known surfactants can be used in the present invention; for instance, anionic surfactants such as fatty acid salts, higher alcoholic ester salts, alkylbenzene sulfonates and/or phosphoric ester salts of higher alcohols; cationic surfactants such as aliphatic amine salts and quaternary ammonium salts; non-ionic surfactants such as higher alcohol ethylene oxide additives, alkyl phenolethylene oxide adducts, aliphatic ethylene oxide adducts, polyalcohol aliphatic esterethylene oxide adducts, aliphatic amidethylene oxide adducts, higher alkylaminethylene oxide adducts, polypropylene glycolethylene oxide adducts, fatty acid ester of polyalcohols and/or fatty acid amide of alkanolamine; and amphoteric surfactants such as amine acids and betaine.

Such surfactants are not particularly limited, however, may be properly non-ionic surfactants such as ethylene oxide adducts of higher alcohols, ethylene oxide adducts of alkylphenol, ethylene oxide-propylene oxide copolymer, ethylene oxide adducts of acetylene glycol. In addition, ethylene oxide adducts having 4–20 addition molar numbers are more preferably employed.

Specifically, preferably used are non-ionic surfactants including ethylene oxide adducts.

-Amount of Surfactant when an Ink Absorption Material B401 is Present Inside- As described above, the lesser the amount of the surfactant is added, the more preferable it is in view of the gas-liquid separation member B402 and the ink. However, if the sub ink tank B400 contains the absorption material B401 in it to hold the ink, the ink must be absorbed by the B401.

Accordingly, the ink preferably contains a surfactant not less than 0.05% by weight, more preferably 0.1% by weight or above.

Examples of coloring agents to be employed in the ink according to the present invention include coloring materials useable in commercial ink-jet inks, with no specific limitations. For instance, conventionally known water-soluble dyes such as water-soluble anionic dyes, direct dyes, acid dyes, reactive dyes and so on can be used. Also, pigments which can be dispersed in an aqueous medium by the action of a dispersant or without a dispersant may be employed in the present invention.

Considering the density of the recorded images and ejection properties of the ink, the content of such a water-soluble dye in the ink is about 0.3–15% by weight based on total weight of the ink. For instance, the water-soluble dyes having anionic groups, usable as the coloring material in the ink in the present invention are as follows:

<Black Ink>

The dyes suitable for black ink are, for instance, C.I. Direct Black 17, C.I. Direct Black 19, C.I. Direct Black 22, C.I. Direct Black 31, C.I. Direct Black 32, C.I. Direct Black 51, C.I. Direct Black 62, C.I. Direct Black 71, C.I. Direct Black 74, C.I. Direct Black 112, C.I. Direct Black 113, C.I. Direct Black 154, C.I. Direct Black 168, C.I. Acid Black 2, C.I. Acid Black 48, C.I. Acid Black 110, C.I. Reactive Black 1, C.I. Reactive Black 8, C.I. Reactive Black 12, C.I. Reactive Black 13, C.I. Food Black 1, C.I. Food Black 2 and the like.

<Yellow Ink>

Dyes suitable for yellow ink are, for instance, C.I. Acid Yellow 11, C.I. Acid Yellow 17, C.I. Acid Yellow 23, C.I. Acid Yellow 25. C.I. Acid Yellow 29, C.I. Acid Yellow 42, C.I. Acid Yellow 49, C.I. Acid Yellow 61, C.I. Acid Yellow 71, C.I. Direct Yellow 12, C.I. Direct Yellow 24, C.I. Direct Yellow 26, C.I. Direct Yellow 44, C.I. Direct Yellow 86, C.I. Direct Yellow 87, C.I. Direct Yellow 98, C.I. Direct Yellow 100, C.I. Direct Yellow 130, C.I. Direct Yellow 142 and the like.

<Magenta Ink>

Dyes suitable for magenta ink are, for instance, C.I. Acid Red 1, C.I. Acid Red 6, C.I. Acid Red 8, C.I. Acid Red 32, C.I. Acid Red 35, C.I Acid Red 37, C.I. Acid Red 51, C.I. Acid Red 52, C.I. Acid Red 80, C.I. Acid Red 85, C.I. Acid Red 87, C.I. Acid Red 92, C.I. Acid Red 94, C.I. Acid Red 115, C.I. Acid Red 254, C.I. Acid Red 289, C.I. Direct red 1, C.I. Direct red 4, C.I. Direct Red 13, C.I. Direct Red 17, C.I. Direct Red 23, C.I. Direct Red 28, C.I. Direct Red 31, C.I. Direct Red 62, C.I. Direct Red 79, C.I. Direct Red 81, C.I. Direct Red 83, C.I. Direct Red 89, C.I. Direct Red 227, C.I. Direct Red 240, C.I. Direct Red 242, C.I. Direct Red 243 and the like.

<Cyan Ink>

Dyes suitable for cyan ink are, for instance, C.I. Acid Blue 9, C.I. Acid Blue 22, C.I. Acid Blue 40, C.I. Acid Blue 59, C.I. Acid Blue 93, C.I. Acid Blue 102, C.I. Acid Blue 104, C.I. Acid Blue 113, C.I. Acid Blue 117, C.I. Acid Blue 120, C.I. Direct Blue 6, C.I. Direct Blue 22, C.I. Direct Blue 25, C.I. Direct Blue 71, C.I. Direct Blue 78, C.I. Direct Blue 86, C.I. Direct Blue 106, C.I. Direct Blue 199 and the like.

Furthermore, dyes having at least one of —COOM groups (wherein M represents an alkali metal, ammonium or organic ammonium) on the molecule can be properly used in the present invention. Particularly, dyes defined by any one of the following formulas (II) to (V) are efficiently used in the present invention.

(II)

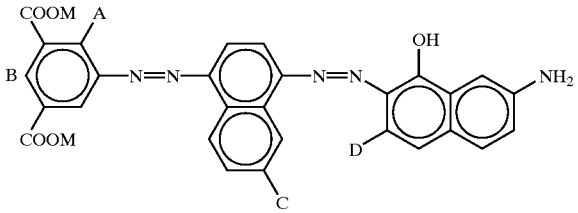

wherein A and B are hydroxyl groups or hydrogen atoms, C is a hydrogen atom or $SO_3M$ and D is $SO_3M$, respectively.

(III)

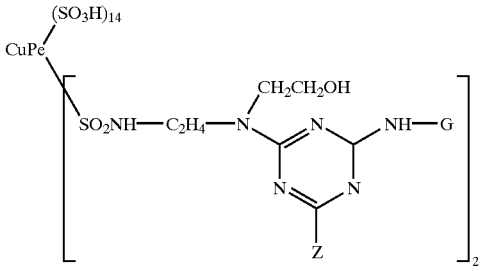

wherein CuP represents phthalocyanine-copper structure and G represents any one of the following formulas (1) to (4);

(1)

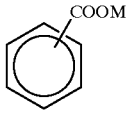

(2)

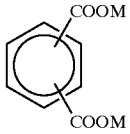

(3)

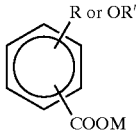

(4)

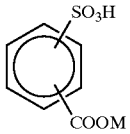

wherein Z is $NHCH_2CH_2OH$ or $N(CH_2CH_2OH)_2$. R and R' in the above formula 3 represents H or lower alkyl groups.

(IV)

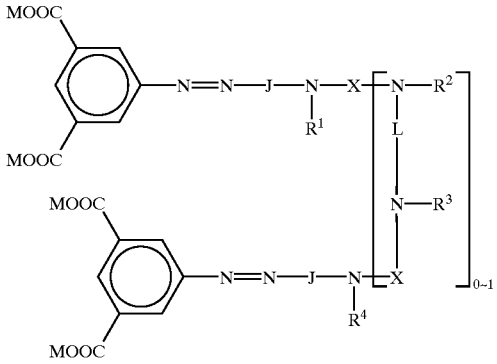

wherein J represents any one of the parts defined by the formulas (5) to (7) below;

(5)

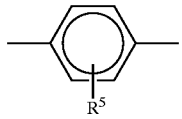

(6)

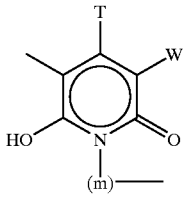

(7)

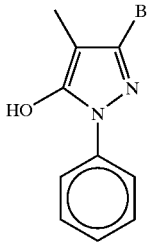

wherein L represents any one of the parts defined by the formulas (8) or (9) below;

$$—CH_2CH_2— \quad (8)$$

(9)

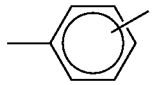

wherein X represents any one of groups defined by the following formulas (10) to (12);

(10)

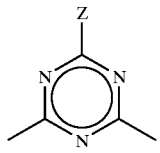

-continued (11)

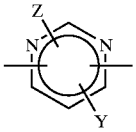

(12)

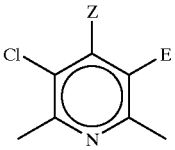

wherein $R^1$–$R^4$ represent —H, or a lower alkyl group, and, for the formulas (5) to (12), B is —H or —COOH, W is —H, —CN, amide or pyrimidinium groups or —COOH, m is integer of 2 to 8, Z is alkoxy group, —OH, alkyl amino group or $NH_2$, and Y is —H, —Cl or —CN, E is —Cl or —CN, $R^5$ is —H or lower alkyl.

-continued (17)

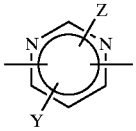

(18)

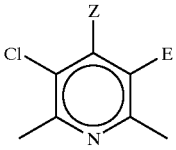

wherein $R_1$ and $R_2$ represent —H or lower alkyl groups or the others and, for the formulas (16) to (18), Z is alkoxy group, —OH, alkylamino group or —$NH_2$ etc. and Y is —H, —Cl or —CN and E is —Cl or —CN.

(V)

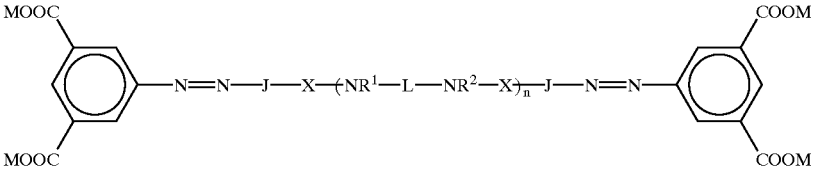

wherein J represents a group defined by the formula (13) below:

(13)

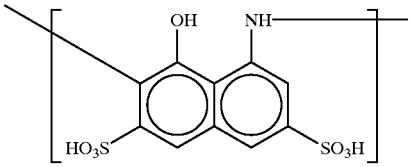

wherein L exhibits any one of the parts defined by the formulas (14) or (15) below;

(14)

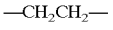

(15)

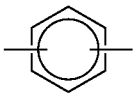

wherein X represents any one of groups defined by the following formulas (16) to (18);

(16)

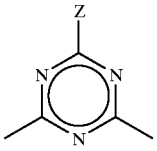

Examples of water-soluble organic solvents usable as an aqueous medium of the present ink include any water-soluble organic solvents unless they deteriorate ink-jet ink's properties.

Other Embodiments

The gas-liquid separation member B402 may be properly selected from the materials having gas-liquid separating function. According to the ink species and use conditions, various materials can be used. For instance, in addition to the gas-permeable membrane made of porous resin materials such as tetrafluoroethylene resin etc., other porous materials such as unglazed porcelain, earthenware and ceramics are properly applicable to produce the gas-liquid separation member B402 according to the present invention.

Additionally, the ink tank of the present invention is not limited to such an ink tank that moves with the recording head in a serial scan type recording apparatus, including an ink tank provided at a predetermined position.

Moreover, the ink-jet cartridge of the present invention may have a constitution in which the ink tank and the recording head are connected either integrally or detachably.

As described above, according to the present invention, a proper ink is used directing an attention to the amount of the detergent in the ink and the surface tension of the ink, so that deterioration of gas-passing function of the gas-liquid separation member is prevented, which enables constantly stable ink supply and maintenance of stable negative pressure characteristics.

Furthermore, according to the present invention, the ink supply by suction is automatically stopped utilizing the function of the gas-liquid separation member. Accordingly, the ink is supplied to the ink tank without fail using a simple constitution, which serves to realize a smaller and lighter recording apparatus and enhance reliability.

What is claimed is:

1. An ink tank for an ink-jet printing apparatus comprising:

(i) an ink container containing an ink;

(ii) an ink inlet for introducing an ink to the ink container; and (iii) an air outlet for making the ink container under negative pressure in cooperation with the ink-jet printing apparatus, an ink being introduced to the ink container through the ink inlet when negative pressure is applied to the ink container, wherein the ink tank further comprises gas-liquid separation means which does not pass liquid but gas at the air outlet, and wherein the ink has surface tension of 28 mN/m or higher but not higher than 50 mN/m; and wherein an inner surface of the ink container has been subjected to a surface processing.

2. The ink tank according to claim 1, wherein the gas-liquid separation means comprises a porous material.

3. The ink tank according to claim 2, wherein the porous material is a porous resin material.

4. The ink tank according to claim 3, wherein the porous resin material is a tetrafluoroethylene resin.

5. The ink tank according to claim 2, wherein the porous material is selected from the group consisting of unglazed porcelain, carthenware and ceramics.

6. The ink tank according to claim 1, wherein the ink tank contains an ink absorbing member capable of absorbing and holding the ink in the ink container.

7. The ink tank according to claim 6, wherein the ink tank has a space between the gas-liquid separation means and the ink absorbing member.

8. The ink tank according to claim 1, where the surface processing is a water-repellent processing.

9. The ink tank according to claim 1, wherein the ink tank further comprises an ink outlet for discharging the ink in the ink container to the outside.

10. The ink tank according to claim 9, wherein an ink-jet recording head capable of ejecting the ink is connected to the ink outlet.

11. The ink tank according to claim 1, wherein the ink has surface tension of 35 mN/m or higher and not higher than 50 mN/m.

12. An ink cartridge comprising an ink tank of claim 1 and an ink-jet recording head for ejecting an ink in the ink tank.

13. An ink cartridge comprising an ink tank of claim 1 and an ink-jet recording head for ejecting the ink in the ink tank, wherein the ink-jet recording head is connected to an ink outlet of the ink tank.

14. An ink system comprising:

a first ink tank comprising an ink tank according to claim 1;

an ink supply device for providing ink to said first ink tank, the ink supply device comprising:

(i) a second ink tank for storing the ink to be introduced to the ink container of the first ink tank;

(ii) means for connecting the second ink tank with the ink inlet of the first ink tank; and (iii) means for reducing a pressure in the ink container of the first ink tank through the air outlet of the first ink tank when the second ink tank is connected to the ink inlet of the first tank.

15. The ink supply device according to claim 14, wherein the connection means comprises an ink supply path communicated to the second ink tank, and a joint at an end of the ink supply path, the joint being connectable to the ink inlet of the first ink tank.

16. The ink supply device according to claim 15, wherein the ink inlet of the first ink tank is provided with a hollow needle, and the ink is introduced from the second ink tank to the ink container through the needle and wherein the joint connects to the needle.

17. The ink supply device according to claim 14, wherein the pressure reducing means comprises a suction pump to reduce a pressure in the ink container through the air outlet.

18. An ink tank for an ink-jet printing apparatus, comprising (i) an ink container containing an ink;

(ii) an ink inlet for introducing an ink to the ink container; and (iii) an air outlet for making the ink container under negative pressure in cooperation with the ink-jet printing apparatus, an ink being introduced to the ink container through the ink inlet when negative pressure is applied to the ink container;

wherein an inner surface of the ink container has been subjected to a surface processing; and wherein the ink tank further comprises a gas-liquid separation means which does not pass liquid but gas at the air outlet, and wherein the ink contains a surfactant in an amount of 1 wt % or less based on the total ink weight.

* * * * *

UNITED STATES PATENT AND TRADEMARK OFFICE

CERTIFICATE OF CORRECTION

PATENT NO. : 6,846,072 B2
DATED : January 25, 2005
INVENTOR(S) : Shinichi Sato et al.

It is certified that error appears in the above-identified patent and that said Letters Patent is hereby corrected as shown below:

Column 7,
Line 29, "trough" should read -- through --; and
Line 30, "cum" should read -- drum --.

Column 13,
Equation (III), line 24, "$(SO_3H)_{14}$" should read -- $(SO_3H)_{1.4}$ -- and "CuPe" should read -- CuPc --.

Column 14,
Lines 35-45, "

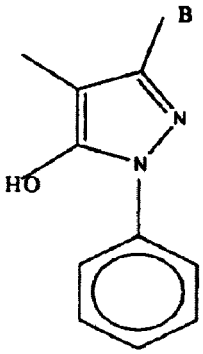

" should read --

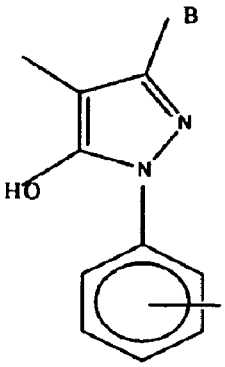

--.

Column 15,
Line 18, "alkyl amino" should read -- alkylamino --.

Signed and Sealed this

Eighteenth Day of October, 2005

JON W. DUDAS
*Director of the United States Patent and Trademark Office*